US012796872B2

(12) United States Patent
Casper

(10) Patent No.: US 12,796,872 B2
(45) Date of Patent: Nov. 17, 2026

(54) SHEET PRODUCT DISPENSERS AND CORRESPONDING METHODS FOR MANUAL DISPENSING OF TWO SHEET PRODUCTS AT A TIME

(71) Applicant: GPCP IP HOLDINGS LLC, Atlanta, GA (US)

(72) Inventor: Ted Allen Casper, Freedom, WI (US)

(73) Assignee: GPCP IP HOLDINGS LLC, Atlanta, GA (US)

( * ) Notice: Subject to any disclaimer, the term of this patent is extended or adjusted under 35 U.S.C. 154(b) by 256 days.

(21) Appl. No.: 18/432,109

(22) Filed: Feb. 5, 2024

(65) Prior Publication Data

US 2024/0260794 A1 Aug. 8, 2024

Related U.S. Application Data

(60) Provisional application No. 63/443,994, filed on Feb. 8, 2023.

(51) Int. Cl.
*A47K 10/42* (2006.01)

(52) U.S. Cl.
CPC ..... *A47K 10/427* (2013.01); *A47K 2010/428* (2013.01)

(58) Field of Classification Search
CPC ..... A47K 10/427; A47K 2010/428; A47K 10/24; B65H 1/08
USPC ..... 221/59, 36, 303; 312/81
See application file for complete search history.

(56) References Cited

U.S. PATENT DOCUMENTS 1,682,580 A * 8/1928 Pratt ..... A47K 10/427 312/61
1,993,885 A * 3/1935 Horwitt ..... A47K 10/427 312/333
2,244,630 A * 6/1941 Metternich ..... A47K 10/427 223/37
2,253,742 A * 8/1941 West ..... A47K 10/422 221/61
3,203,586 A * 8/1965 Downham ..... A47K 10/427 221/56
3,214,227 A * 10/1965 Filipowicz ..... A47K 10/427 206/559
3,679,096 A * 7/1972 Musser ..... B65D 83/0817 221/56
3,765,565 A * 10/1973 Fietzer ..... A47K 10/427 221/46

(Continued)

FOREIGN PATENT DOCUMENTS

AU 2015263424 B2 1/2017
CN 207886155 U 9/2018

(Continued)

*Primary Examiner* — Rakesh Kumar

(57) ABSTRACT

Dispensers, systems, and methods for providing manual two-at-a-time sheet product dispensing are provided herein. A sheet product dispenser comprises a housing configured to hold a plurality of folded sheet products, a biasing element, and a ramp. The biasing element is configured to push the plurality of folded sheet products along the ramp such that portions of a first folded sheet product and a second folded sheet product fall through an opening of the housing. The first folded sheet product and the second folded sheet product are dispensable upon a single manual removal by a user.

19 Claims, 12 Drawing Sheets

(56) References Cited

U.S. PATENT DOCUMENTS 4,170,325 A * 10/1979 Pawlowski ..... B65D 5/725 221/311
4,329,001 A * 5/1982 Filipowicz ..... A47K 10/427 312/190
4,643,334 A * 2/1987 Steele ..... B65H 1/06 221/311
4,678,099 A * 7/1987 Matsui ..... A47K 10/424 221/48
4,768,679 A 9/1988 Matsui
4,838,454 A * 6/1989 Salzmann ..... A47K 10/427 312/61
4,877,154 A 10/1989 Matsui
4,953,747 A * 9/1990 Wenkman ..... A47K 10/427 221/56
5,076,466 A * 12/1991 Petterson ..... A47K 10/427 312/61
5,957,325 A * 9/1999 Montanez ..... A47F 1/08 221/281
6,286,713 B1 9/2001 Chan
6,352,172 B1 3/2002 Chan
6,378,726 B1 4/2002 Chan
6,602,575 B2 * 8/2003 Lefevre Du Grosriez ..... B65H 29/00 428/124
6,622,888 B2 9/2003 Boone
6,874,653 B2 4/2005 Boone
6,892,898 B1 5/2005 Boone
7,234,610 B2 6/2007 Skarda
7,568,593 B2 8/2009 Cittadino
7,938,294 B2 5/2011 Cittadino
8,408,419 B2 * 4/2013 Rippl ..... A47K 10/42 221/45
9,282,830 B2 * 3/2016 Jones ..... A47F 1/08
9,345,368 B2 5/2016 Formon
9,622,627 B2 4/2017 Wilson
9,717,379 B2 8/2017 Denis
D807,035 S * 1/2018 Beller ..... D3/302
9,901,222 B2 2/2018 Wilson
10,384,856 B2 * 8/2019 DeGraaf ..... B65D 25/005
10,405,705 B2 9/2019 Formon
10,588,468 B2 * 3/2020 Monsalve Cordova ..... A47K 10/426
11,051,664 B2 7/2021 Billman
11,116,365 B2 9/2021 Kunda
11,297,984 B2 * 4/2022 Case ..... B65H 33/18
12,042,099 B2 7/2024 Kunda
2002/0060222 A1 * 5/2002 Bando ..... A47K 10/421 221/48
2004/0155051 A1 * 8/2004 Magid ..... G07B 3/04 221/59
2013/0221019 A1 * 8/2013 Rozek ..... A47K 10/427 221/36
2013/0228587 A1 * 9/2013 Formon ..... A47K 10/424 221/210
2014/0284241 A1 * 9/2014 Pearson ..... A47K 10/421 428/126
2015/0014344 A1 1/2015 Wilson
2015/0147521 A1 * 5/2015 Hochtritt ..... A47K 10/16 428/126
2019/0343344 A1 11/2019 Billman
2024/0260794 A1 * 8/2024 Casper ..... A47K 10/427

FOREIGN PATENT DOCUMENTS

CN 209547863 U 10/2019
DE 102017205776 A1 10/2018

* cited by examiner

SHEET PRODUCT DISPENSERS AND CORRESPONDING METHODS FOR MANUAL DISPENSING OF TWO SHEET PRODUCTS AT A TIME

RELATED APPLICATIONS

This application claims priority to U.S. Provisional Application No. 63/443,994, filed on Feb. 8, 2023, which is incorporated by reference herein in its entirety.

TECHNICAL FIELD

This disclosure generally relates to napkin dispensing systems for food service and, more particularly, to systems for dispensing two sheet products upon a single manual removal by a user.

BACKGROUND

Napkin dispensers are often provided at food service locations. Some napkin dispensers include a stack of folded napkins supported on a pressure plate that is adapted to slide within the body of the dispenser. A cover is mounted on one end of the dispenser body and has an opening through which the napkins are dispensed.

Such manual napkin dispensers are often limited in function and various dispensing issues occur frequently. Such issues include, for example, only dispensing one napkin at a time, which may require additional pulls by a user (as one napkin is not usually enough, particularly for filling a food service order). In some cases, the presented napkin can be ripped or torn easily. In other cases, too many napkins can be dispensed due to clumping or other issues, which can be detrimental to inventory and/or quality control.

Some napkin dispensers provide a motor or other automated features in an effort to control dispensing, however, such dispensers are not cost-effective and have moving parts that can lead to undesirable maintenance issues.

BRIEF SUMMARY

Embodiments of the disclosure provide dispensers, systems, and methods for easy and/or controlled manual dispensing of sheet product. In some embodiments, various features are provided herein to encourage consistent and hygienic dispensing of sheet product, such as napkins.

In some embodiments, a sheet product dispenser with a ramp, biasing element, and opening is designed to encourage a crease of a first folded sheet product and a leading end of a second, subsequent folded sheet product to fall through the opening and be presented for retrieval of both the first and second folded sheet product in a single manual dispense. Some such example sheet product dispensers provide two folded napkins in a single manual dispense, limiting unnecessary extra pulls, which is more efficient and beneficial, such as for a food service operator during preparation of a food service order.

In some embodiments, the design of various features of example sheet product dispensers aid in control of the dispensing operation, such as to provide only two (and not more) napkins. For example, some embodiments provide features that encourage pulling at the crease so as to lead to the desired two napkin dispense. As another example, a curvature of the ramp may be designed to discourage removal of a third napkin or even more napkins, while encouraging removal of the first and second napkins. Notably, various additional features are described herein for aiding in encouraging desirable manual sheet product dispensing.

In an example embodiment, a sheet product dispenser is provided. The sheet product dispenser includes a housing defining an interior volume and including a bottom surface and a front surface. The front surface defines, at least in part, an opening. The sheet product dispenser also includes a plurality of folded sheet products positioned within the interior volume. Each of the plurality of folded sheet products has a length from a first end to a second end and a width, and each of the plurality of folded sheet products includes a crease extending along the width at a position between the first end and the second end. The plurality of folded sheet products includes at least a first folded sheet product and a second folded sheet product positioned subsequent to the first folded sheet product, and the plurality of folded sheet products are interleaved such that a first end of the second folded sheet product is positioned within the crease of the first folded sheet product. The sheet product dispenser also includes a biasing element disposed within the housing, and the biasing element is configured to bias the plurality of folded sheet products toward the opening. The sheet product dispenser also includes a ramp disposed on the bottom surface of the housing proximate the front surface or a side surface of the housing proximate the front surface. The ramp leads from the bottom surface toward the opening or from the side surface toward a center of the opening. The bias of the biasing element on the plurality of folded sheet products causes the first folded sheet product and the second folded sheet product to move along the ramp and causes the crease of the first folded sheet product to fall through the opening such that the crease of the first folded sheet product and the first end of the second folded sheet product fall at least partially through the opening and are presented to a user to enable the user to grab the crease of the first folded sheet product along with the first end of the second folded sheet product such that a single manual removal of the crease of the first folded sheet product dispenses both the first folded sheet product and the second folded sheet product to the user.

In some embodiments, the first folded sheet product may define a first portion extending between the first end and the crease, and an exterior portion of the front surface may define an indentation such that at least portions of the crease of the first folded sheet product and the first portion of the first folded sheet product overlay the indentation.

In some embodiments, both the first folded sheet product and the second folded sheet product may be dispensed when the user grabs the crease of the first folded sheet product within the indentation and pulls the first folded sheet product and the second folded sheet product out from the housing.

In some embodiments, the first portion may define a first length, and the indentation may have a second length in a vertical direction that is less than the first length of the first portion of the first folded sheet product such that the first portion covers the indentation when the crease of the first folded sheet product is presented to the user.

In some embodiments, the first folded sheet product may define a first portion extending between the first end and the crease, and the first portion may define a first length. An exterior portion of the front surface may extend downwardly from the opening and may define a second length that is greater than the first length such that the first end of the first folded sheet product is above a bottom edge of the exterior portion of the front surface when the crease of the first folded sheet product is presented to the user.

In some embodiments, the ramp may be disposed on the bottom surface of the housing proximate the front surface, and the sheet product dispenser may further include a side ramp disposed within the housing. The side ramp may be adjacent to the ramp and an interior portion of the front surface, and the side ramp may have a retention edge.

In some embodiments, a height of the side ramp may be between 1.25 inches and 2.5 inches.

In some embodiments, the retention edge may be a plurality of ribs oriented horizontally such that the plurality of folded sheet products can glide along a horizontal direction but such that the plurality of ribs exert a frictional force on the plurality of folded sheet products in a vertical direction.

In some embodiments, the sheet product dispenser may further include a third folded sheet product of the plurality of folded sheet products that is adjacent to the second folded sheet product, and a curvature of the ramp may cause removal of force from the first folded sheet product and the second folded sheet product but retaining of force on the third folded sheet product such that the single manual removal of the crease of the first folded sheet product dispenses both the first folded sheet product and the second folded sheet product, but not the third sheet product, to the user.

In some embodiments, the sheet product dispenser may further include a fourth folded sheet product of the plurality of folded sheet products that is adjacent to the third folded sheet product, and the single manual removal of the crease of the first folded sheet product may cause a second end of the third folded sheet product and a crease of the fourth folded sheet product to move along the ramp under the bias of the biasing element to cause a crease of the third folded sheet product to fall through the opening such that the crease of the third folded sheet product and a first end of the fourth folded sheet product fall at least partially through the opening and are presented to the user.

In some embodiments, an external portion of the front surface may define an external edge at a top of the front surface, and the front surface may define a height such that the crease of the first folded sheet product rests along the external edge when the first folded sheet product and the second folded sheet product are ready to be dispensed together.

In some embodiments, the first folded sheet product may define a first portion extending between the first end and the crease, and the first portion may define a first length. The height of the front surface and the first length of the first folded sheet product may define a ratio that is 2:3 or less.

In some embodiments, a height of the ramp may be between 0.5 inches and 1.5 inches.

In some embodiments, an angle of the ramp relative to the bottom surface may be between 20 degrees and 60 degrees.

In some embodiments, the ramp may have a first portion that has a first radius of curvature, the first portion being adjacent to the bottom surface, and the ramp may have a second portion that has a second radius of curvature, the second portion being adjacent to an interior portion of the front surface. The first radius of curvature may be less than the second radius of curvature.

In some embodiments, the biasing element may exert a force onto the plurality of folded sheet products, and a curvature of the ramp may cause less of the force to be applied to the first folded sheet product and the second folded sheet product when the ramp forces the first folded sheet product and the second folded sheet product along the ramp to cause the crease of the first folded sheet product and the first end of the second folded sheet product to be presented to the user such that it is easier to remove the first folded sheet product and the second folded sheet product relative to the third folded sheet product and other folded sheet products of the plurality of folded sheet products and so as to encourage removal of only the first folded sheet product and the second folded sheet product with the single manual removal.

In some embodiments, the first folded sheet product may define a first portion extending between the first end and the crease, and a weight of the first portion of the first folded sheet product may enable the crease of the first folded sheet product to fall through the opening and hang at a position relative to the front surface that encourages removal of two sheet products with the single manual removal.

In some embodiments, the sheet product dispenser may be a napkin dispenser.

In another example embodiment, a system is provided for dispensing sheet products. The system includes a housing defining an interior volume. The housing is configured to accept a plurality of folded sheet products, and each of the plurality of folded sheet products has a length from a first end to a second end and a width. Each of the plurality of folded sheet products includes a crease extending along the width at a position between the first end and the second end, and the plurality of folded sheet products includes at least a first folded sheet product and a second folded sheet product positioned subsequent to the first folded sheet product. The plurality of folded sheet products are interleaved such that a first end of the second folded sheet product is positioned within the crease of the first folded sheet product. The housing further includes a bottom surface and a front surface that, alone or together with a top portion of the housing, creates an opening for a crease of the first folded sheet product to fall through. The system also includes a biasing element disposed within the housing. The biasing element is configured to bias the plurality of folded sheet products toward the opening. The system also includes a ramp disposed on the bottom surface of the housing proximate the front surface or a side surface of the housing proximate the front surface, and the ramp leads from the bottom surface toward the opening or from the side surface toward a center of the opening. The bias of the biasing element on the plurality of folded sheet products causes the first folded sheet product and the second folded sheet product to move along the ramp and causes the crease of the first folded sheet product to fall through the opening such that the crease of the first folded sheet product and the first end of the second folded sheet product fall at least partially through the opening and are presented to a user to enable the user to grab the crease of the first folded sheet product along with the first end of the second folded sheet product such that a single manual removal of the crease of the first folded sheet product dispenses both the first folded sheet product and the second folded sheet product to the user.

In another example embodiment, a method of manufacturing a sheet product dispenser is provided. The method includes forming a housing. The housing defines an interior volume for holding a plurality of folded sheet products, and the housing includes a bottom surface and a front surface that defines an opening for a crease of a first folded sheet product to fall through. The method also includes positioning a biasing element within the housing. The biasing element is configured, in operation, to bias the plurality of folded sheet products toward the opening. The method also includes positioning a ramp on the bottom surface of the housing proximate the front surface or a side surface of the housing proximate the front surface. The ramp leads from the bottom surface toward the opening or from the side surface toward a center of the opening.

Some embodiments include apparatuses, systems, and methods including various example embodiments, such as described herein.

BRIEF DESCRIPTION OF THE SEVERAL VIEWS OF THE DRAWING(S)

The present application is illustrated by way of example and not limited in the accompanying figures in which like reference numerals indicate similar elements and in which.

DETAILED DESCRIPTION

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements.

As used herein, a "user" of example sheet product dispensers may be a maintainer (e.g., a maintenance person, a janitor, a facility manager, etc.) or a consumer (e.g., a person receiving a dispensed portion of the sheet product).

As used herein, the term "sheet product" may include a product that is relatively thin in comparison to its length and width. Further, the sheet product may define a relatively flat, planar configuration. In some embodiments, the sheet product is flexible or bendable to permit, for example, folding, rolling, stacking, or the like. In this regard, sheet products may, in some cases, be formed into interleaved stacks for use with various embodiments described herein. Some example sheet products include napkin, towel, bath tissue, facial tissue, wipe, wrapping paper, aluminum foil, wax paper, plastic wrap, or other sheet-like products. Sheet products may be made from paper, cloth, non-woven, metallic, polymer or other materials, and in some cases may include multiple layers or plies.

Some embodiments described herein are designed to maximize efficiency of maintenance, usage, and operation for product dispensers. In this regard, some of the embodiments are designed to provide for easy and intuitive dispensing of sheet products (e.g., napkins). Additionally, some embodiments seek to provide a manual two-at-a-time dispensing operation of the sheet product dispenser, such as by providing a dispensing mechanism for interleaved sheet products. Further, some embodiments seek to provide a corrective dispensing operation of the sheet product dispenser that allows for the desired dispensing no matter the orientation of the loaded sheet product. In this regard, in some embodiments, the sheet product dispenser may dispense a single sheet product before returning to two-at-a-time dispensing when it is improperly loaded. Additional benefits sought by various embodiments include providing hygienic dispensing of sheet products and avoidance of scenarios in which only one sheet product, or in which three or more sheet products, are dispensed in an instance, among many other benefits that are evident to one of ordinary skill in the art based on the disclosure herein.

Figure 1:
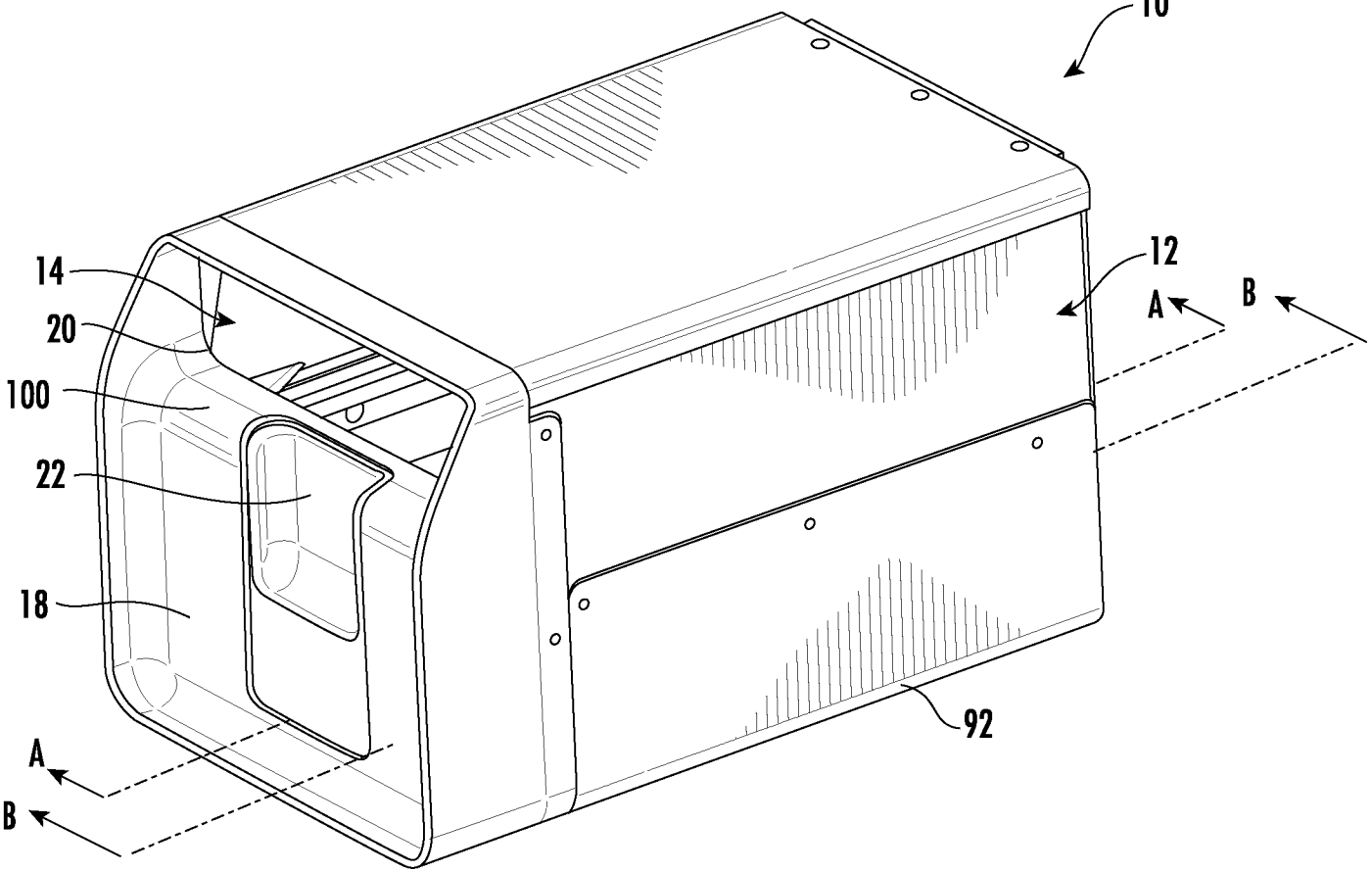
FIG. 1 shows a perspective view of an example sheet product dispenser, in accordance with some embodiments discussed herein.

FIG. 1 illustrates an example sheet product dispenser 10 according to some embodiments. The sheet product dispenser 10 may be configured to dispense two sheet products at a time. In some embodiments, the sheet product dispenser 10 may be a napkin dispenser configured to manually dispense two napkins at a time with a single pull event, but in other embodiments, the sheet product dispenser 10 may be configured to dispense any other type of sheet product. The sheet product dispenser 10 of FIG. 1 may include a housing 12 that defines an interior volume 14. The housing may be defined by a bottom surface 16 (shown in FIG. 5) and a front surface 18. The sheet product dispenser 10 may include an opening 20 through which a sheet product (e.g., a napkin) can be presented to a user. The opening 20 may be defined by the front surface 18 alone or together with a top portion of the housing 12. In some embodiments, the sheet product dispenser may include an indentation 22 configured to enable and encourage a user to grab a sheet product in a certain way (e.g., at a center portion of a crease as described herein).

Figure 2:
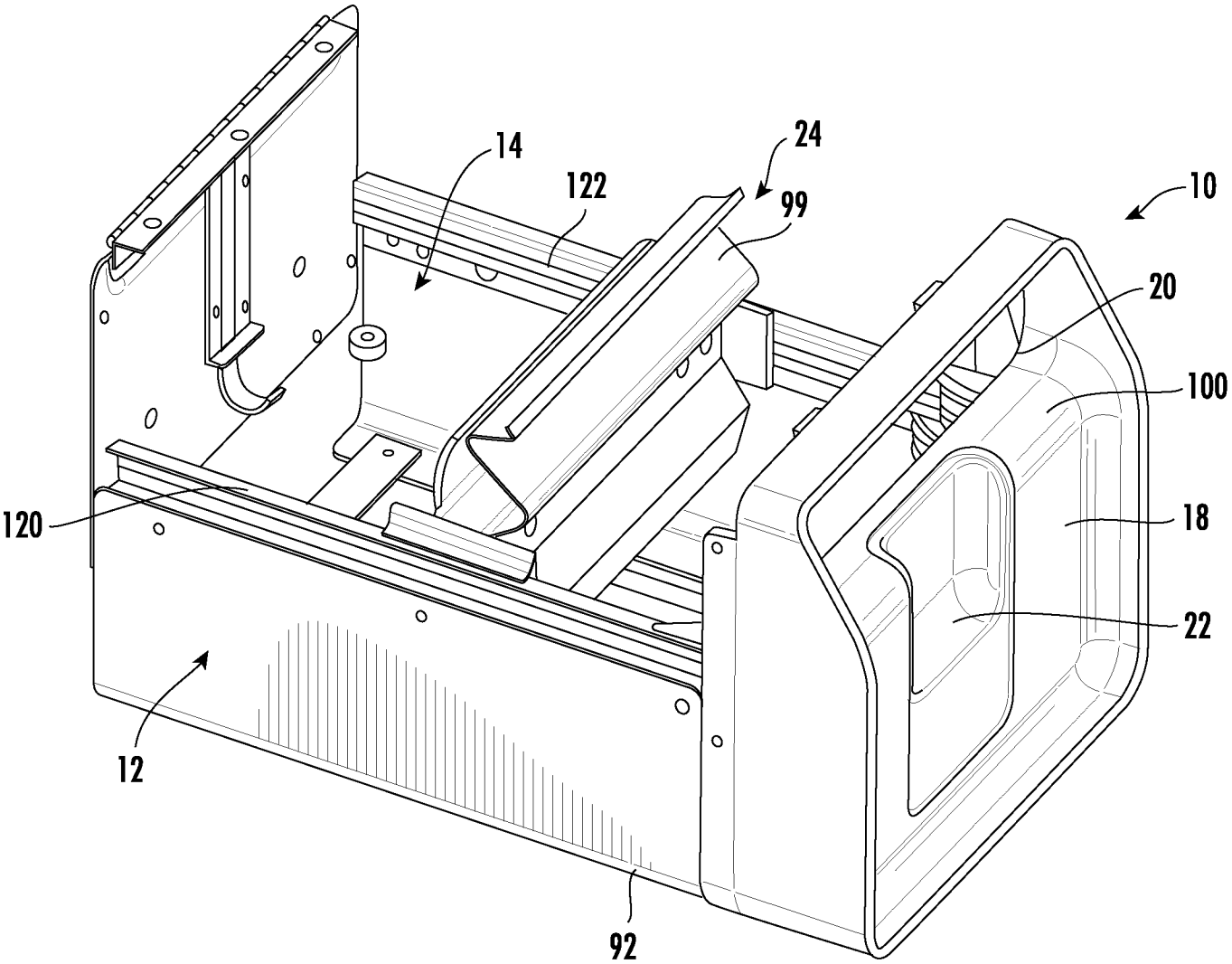
FIG. 2 shows a top perspective view of an example sheet product dispenser with a top portion removed, in accordance with some embodiments discussed herein.
Figure 5:
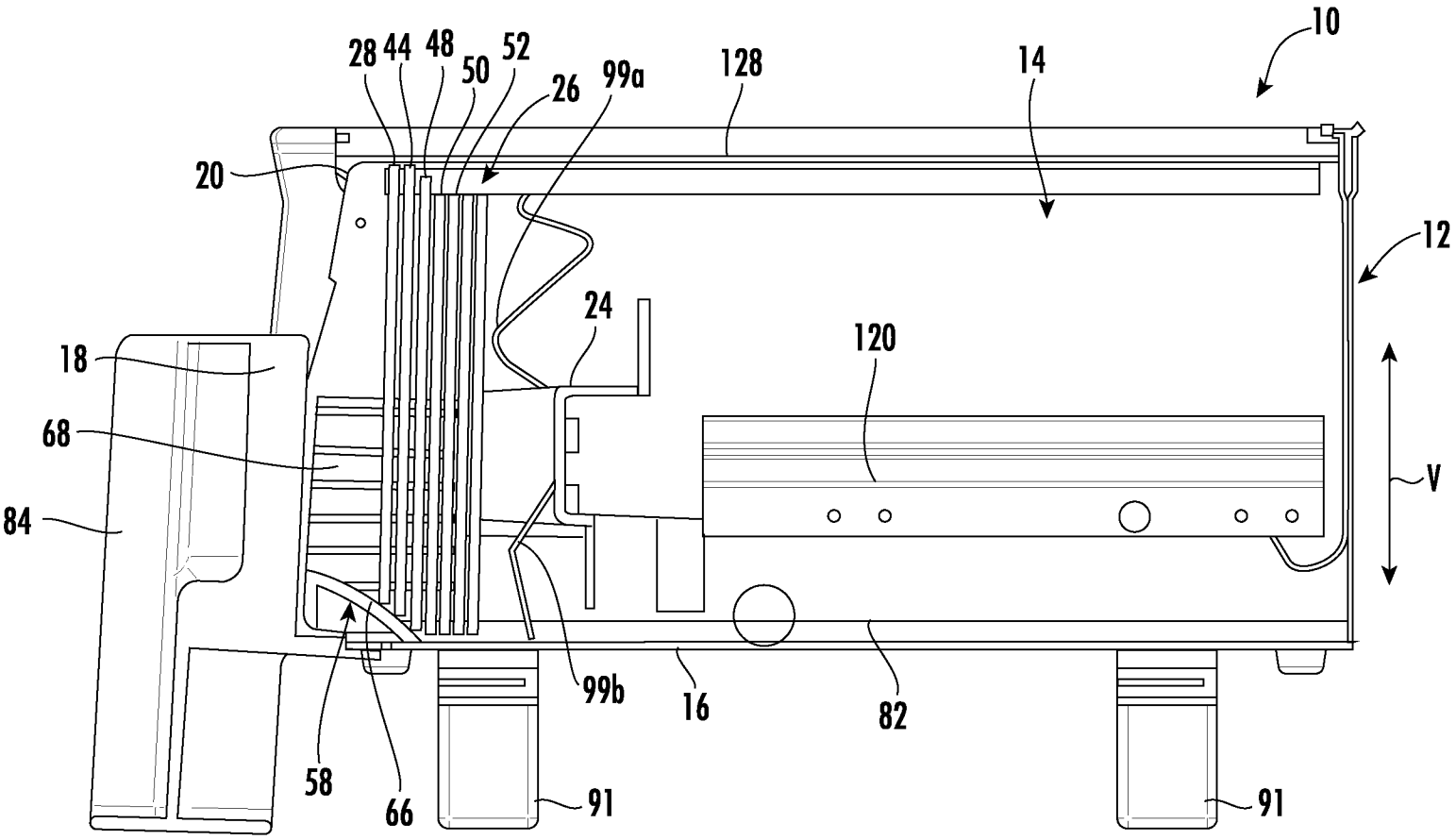
FIG. 5 is a cross-sectional view of the example sheet product dispenser in FIG. 1 taken along line A-A, illustrating a plurality of folded sheet products disposed therein, in accordance with some embodiments discussed herein.

FIG. 2 illustrates an alternative view of the example sheet product dispenser 10 of FIG. 1, wherein a top section of the sheet product dispenser 10 has been removed from view, such as for illustrative purposes. The sheet product dispenser 10 may have a biasing element 24 configured to bias a plurality of folded sheet products 26 toward the opening 20. In some embodiments, the biasing element 24 may be spring-biased. In other embodiments, the biasing element 24 may be any other mechanism which is useful to apply a force onto a plurality of folded sheet products such that the plurality of folded sheet products is guided towards the opening 20. Further, in some embodiments, the biasing element may optionally include an attachment, such as a push plate. In the illustrated embodiment, the biasing element 24 includes a push plate 99 that includes a top portion 99*a* and a bottom portion 99*b* (shown in FIG. 5). With reference to FIG. 5, the top portion 99*a* may protrude further toward the folded sheet product 26 than the bottom portion 99*b*. In some embodiments, such a configuration of the push plate 99 may work together with other features, such as a ramp 58, to encourage behavior of the folded sheet product (e.g., the protruding top portion 99*a* may encourage a crease of a first folded sheet product to fall through the opening 20).

Figure 3A:
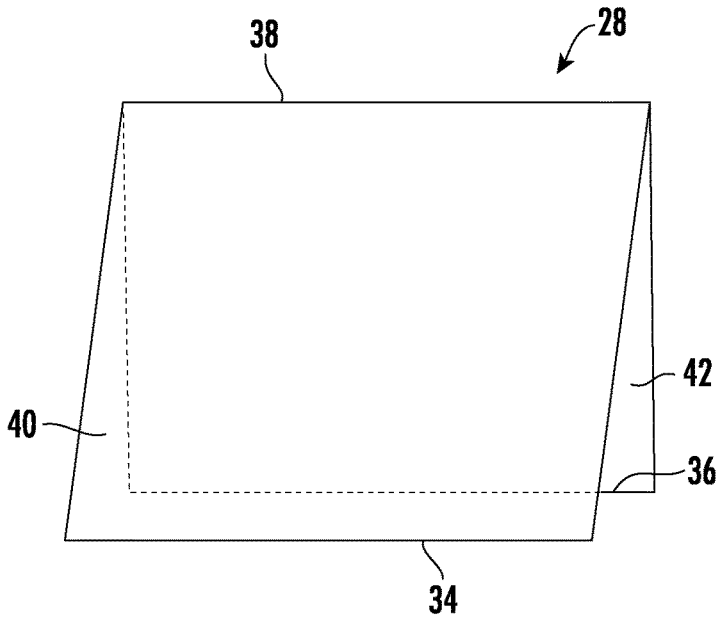
FIG. 3A shows a perspective view of a folded sheet product, such as a napkin, in accordance with some embodiments discussed herein.
Figure 3B:
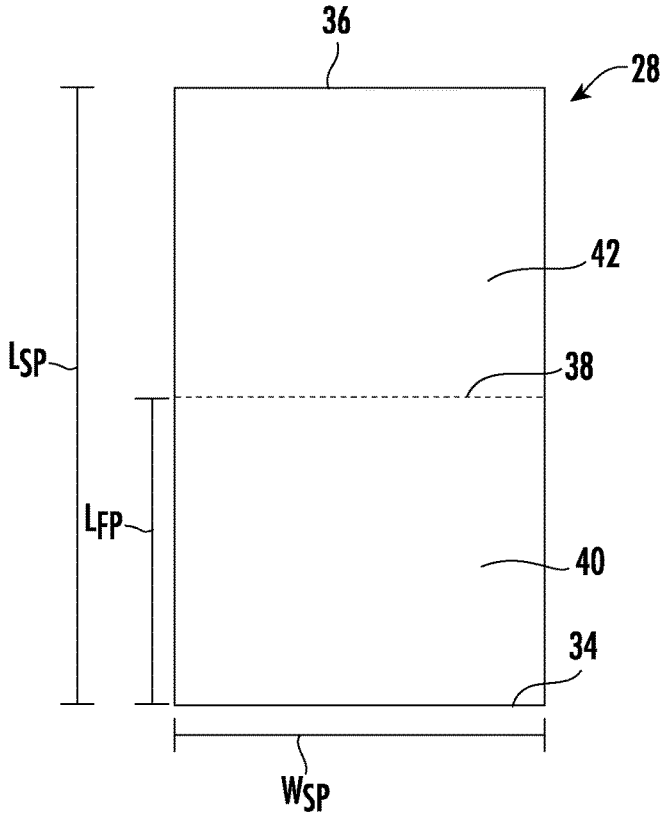
FIG. 3B shows a top view of a sheet product in an unfolded position, in accordance with some embodiments discussed herein.
Figure 4:
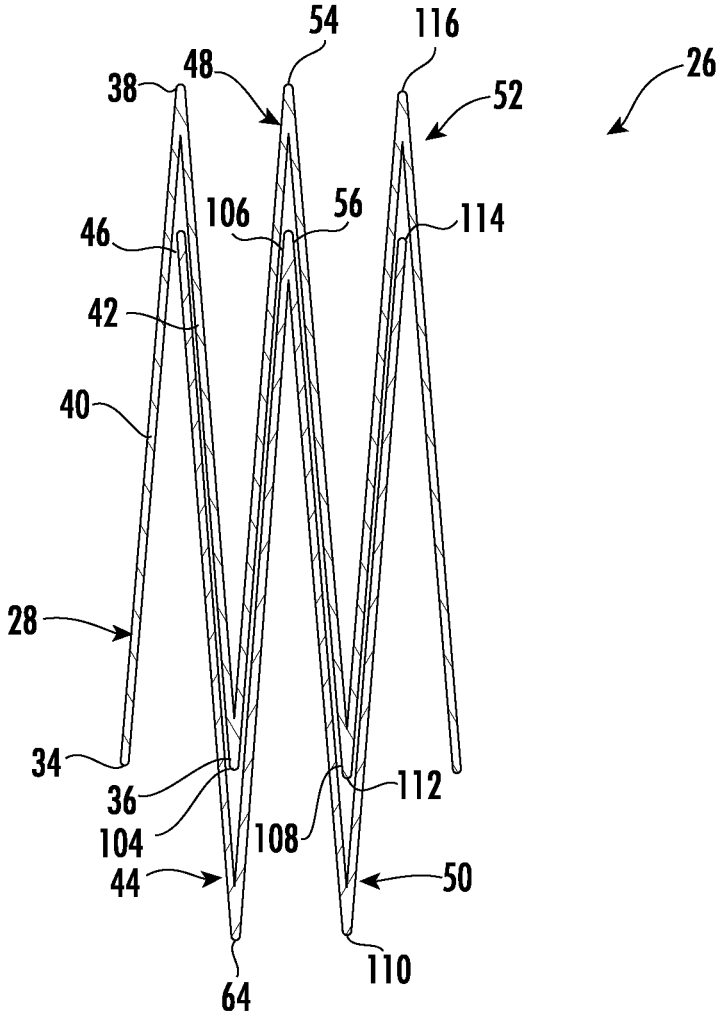
FIG. 4 shows a side view of a plurality of folded sheet products, in accordance with some embodiments discussed herein.
Figure 6:
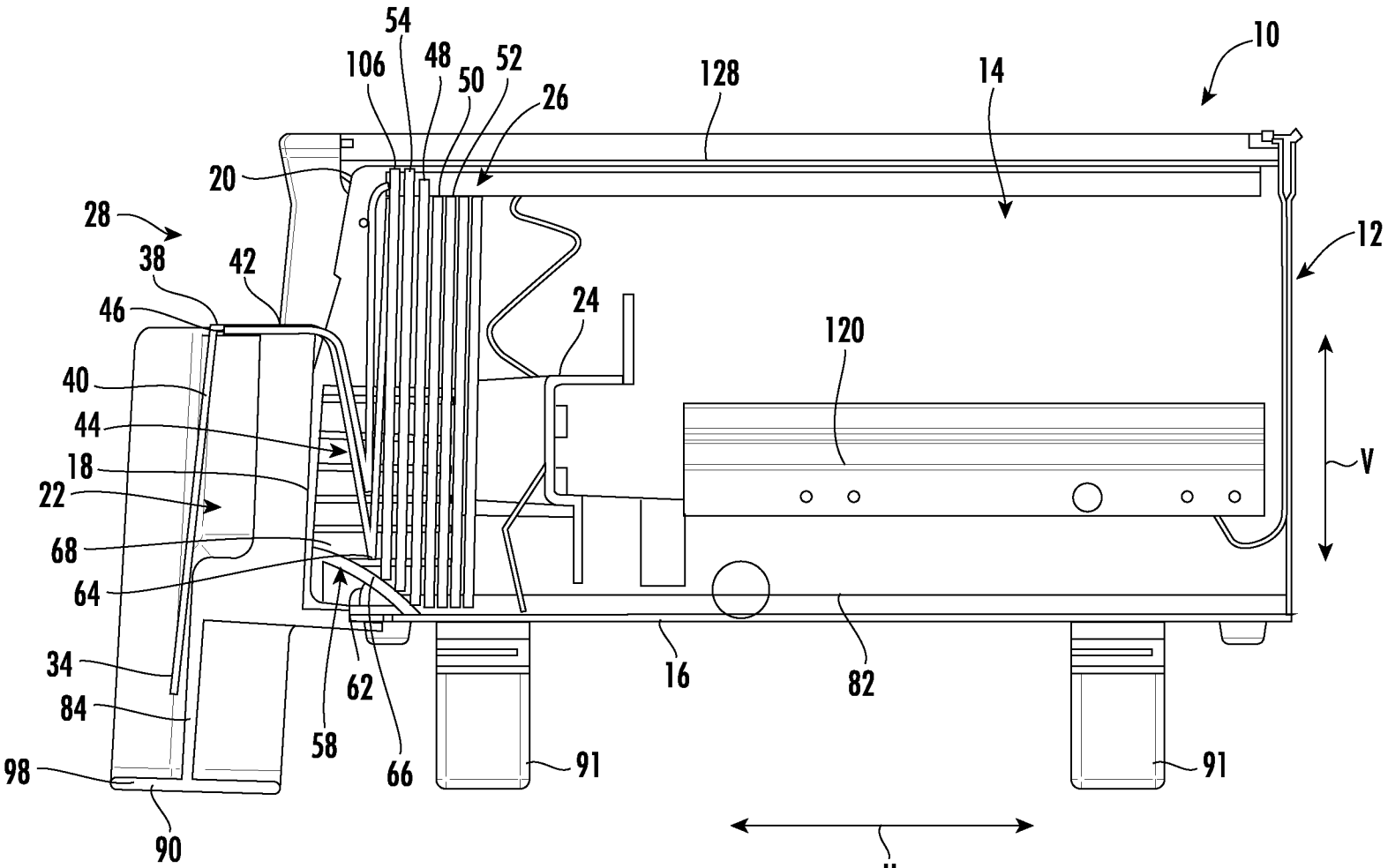
FIG. 6 is the cross-sectional view shown in FIG. 5, illustrating a first folded sheet product presented to a user, in accordance with some embodiments discussed herein.

In some embodiments, the sheet product dispenser 10 may be configured to dispense two sheet products (e.g., napkins) in response to a single removal maneuver by a user. For example, with reference to FIG. 6, the sheet product dispenser 10 may be configured to dispense both a first folded sheet product 28 and a second folded sheet product 44 when a user grabs a crease 38 of the first folded sheet product 28. FIGS. 3A-3B show a first folded sheet product 28 which may be representative of each of the plurality of folded sheet products 26, which are illustrated in FIGS. 4-6. The first folded sheet product 28 may have a width $W_{SP}$ and a length $L_{SP}$ from a first end 34 to a second end 36. The first folded sheet product 28 may also have the crease 38 that extends along the width $W_{SP}$ at a position between the first end 34 and the second end 36. Further, the folded sheet product may define a first portion 40 that extends between the first end 34 and the crease 38 and a second portion 42 that extends between the second end 36 and the crease 38. As shown in FIG. 3A, the first folded sheet product 28 may be foldable along the crease 38. In other embodiments, the folded sheet product 28 may be configured differently. For example, the folded sheet product 28 may be trifold, such that it has two creases instead of one, and such that two of its three portions are folded on top of each other such that the folded sheet product assumes the same V-shape as the embodiment shown in FIG. 3A. Further, in other embodiments, the folded sheet product 28 may have any other configuration that allows for two sheet products to be dispensed in response to a single removal maneuver by a user.

FIG. 4 illustrates an example plurality of folded sheet products 26 that are interleaved. The plurality of folded sheet products 26 may be interleaved such that a first end 46 of a second folded sheet product 44 is positioned within the crease 38 of the first folded sheet product 28 and such that the second end 36 of the first folded sheet product 28 is positioned within a crease 64 of the second folded sheet product 44. Similarly, a first end 104 of a third folded sheet product 48 may be positioned within a crease 64 of the second folded sheet product 44, and a second end 106 of the second folded sheet product 44 may be positioned within a crease 54 of the third folded sheet product 48. A first end 56 of a fourth folded sheet product 50 may be positioned within a crease 54 of a third folded sheet product 48, and a second end 108 of the third folded sheet product 48 may be positioned within a crease 110 of the fourth folded sheet product 50. Finally, a first end 112 of a fifth folded sheet product 52 may be positioned within the crease 110 of the fourth folded sheet product 50, and a second end 114 of the fourth folded sheet product 50 may be positioned within a crease 116 of the fifth folded sheet product 52. In the embodiment illustrated in FIG. 4, only five folded sheet products are depicted. However, in many embodiments, the plurality of folded sheet products 26 may include more than five folded sheet products. Further, in other embodiments, the plurality of folded sheet products 26 may include less than five folded sheet products.

FIG. 5 illustrates the plurality of folded sheet products 26, which may be disposed within the interior volume 14 of the housing 12 of the sheet product dispenser 10. As shown, the plurality of folded sheet products 26 may be positioned between the opening 20 and the biasing element 24. In some embodiments, the sheet product dispenser 10 may include a ramp 58, as shown in FIG. 5. The ramp 58 may be disposed on the bottom surface 16 of the housing 12, such that it is proximate the front surface 18. Alternatively, the ramp 58 may be disposed on a side surface of the housing 12 proximate the front surface 18. Further, the ramp 58 may lead from the bottom surface 16 toward the opening 20 or from the side surface toward a center of the opening 20. In some embodiments, a height 60 of the ramp 58 may be between 0.5 inches and 1.5 inches. In other embodiments, the height 60 of the ramp 58 may be any other height which permits the plurality of folded sheet products 26 to be presented to the user through the opening 20. In some embodiments, an angle 62 of the ramp 58 relative to the bottom surface 16 or the side surface may be between 20 degrees and 60 degrees (shown in FIG. 6). In other embodiments, the angle 62 of the ramp 58 relative to the bottom surface 16 or the side surface may be any other angle which provides an appropriate force on the plurality of folded sheet products 26, as will be discussed in more detail herein. Notably, in some embodiments, the angle may be defined by the bottom surface or the side surface and a line tangent to a curvature of the ramp 58 along a point thereof.

Referring now to FIGS. 5-6, the ramp 58 may be configured so that the first folded sheet product 28 and the second folded sheet product 44 move along the ramp 58 under the bias of the biasing element 24. A weight of the first portion 40 of the first folded sheet product 28 may cause the first end 34 and the crease 38 of the first folded sheet product 28 to fall through the opening 20 such that the crease 38 of the first folded sheet product 28 and the first end 46 of the second folded sheet product 44 fall at least partially through the opening 20 and are presented to a user (as shown in FIG. 6). The presentation of the first folded sheet product 28 and the second folded sheet product 44 (underneath the crease 38) enable the user to grab the crease 38 of the first folded sheet product 28 along with the first end 46 of the second folded sheet product 44 such that a single manual removal of the crease 38 of the first folded sheet product 28 dispenses both the first folded sheet product 28 and the second folded sheet product 44 to the user. In this regard, by a user grabbing the crease 38 of the first folded sheet product 28, they necessarily grab the first end 46 of the second folded sheet product 44—such that by pulling out the crease 38, they will pull out both the first folded sheet product 28 and the second folded sheet product 44 in a single motion.

The ramp 58 may be configured to lessen and/or direct a force applied by the biasing element 24. In some embodiments, the ramp 58 may be designed to lessen the force applied on the first folded sheet product 28 and the second folded sheet product 44 relative to the remaining folded sheet product 26 such that the first folded sheet product 28 and the second folded sheet product 44 are more easily removed from the dispenser. In this regard, the lessening of the force on the first folded sheet product 28 and the second folded sheet product 44 may reduce an amount of pull force that a user must apply to cause the first folded sheet product 28 and the second folded sheet product 44 to be dispensed. It also may prevent the third folded sheet product 48 and the other folded sheet products of the plurality of folded sheet products 26 from being dispensed, as well as from tabbing or tearing. In some embodiments, the relative lessening of the force on the first folded sheet product 28 and the second folded sheet product 44 may aid in causing the crease 38 of the first folded sheet product 28 and the first end 46 of the second folded sheet product 44 to fall through the opening 20.

Figure 7:
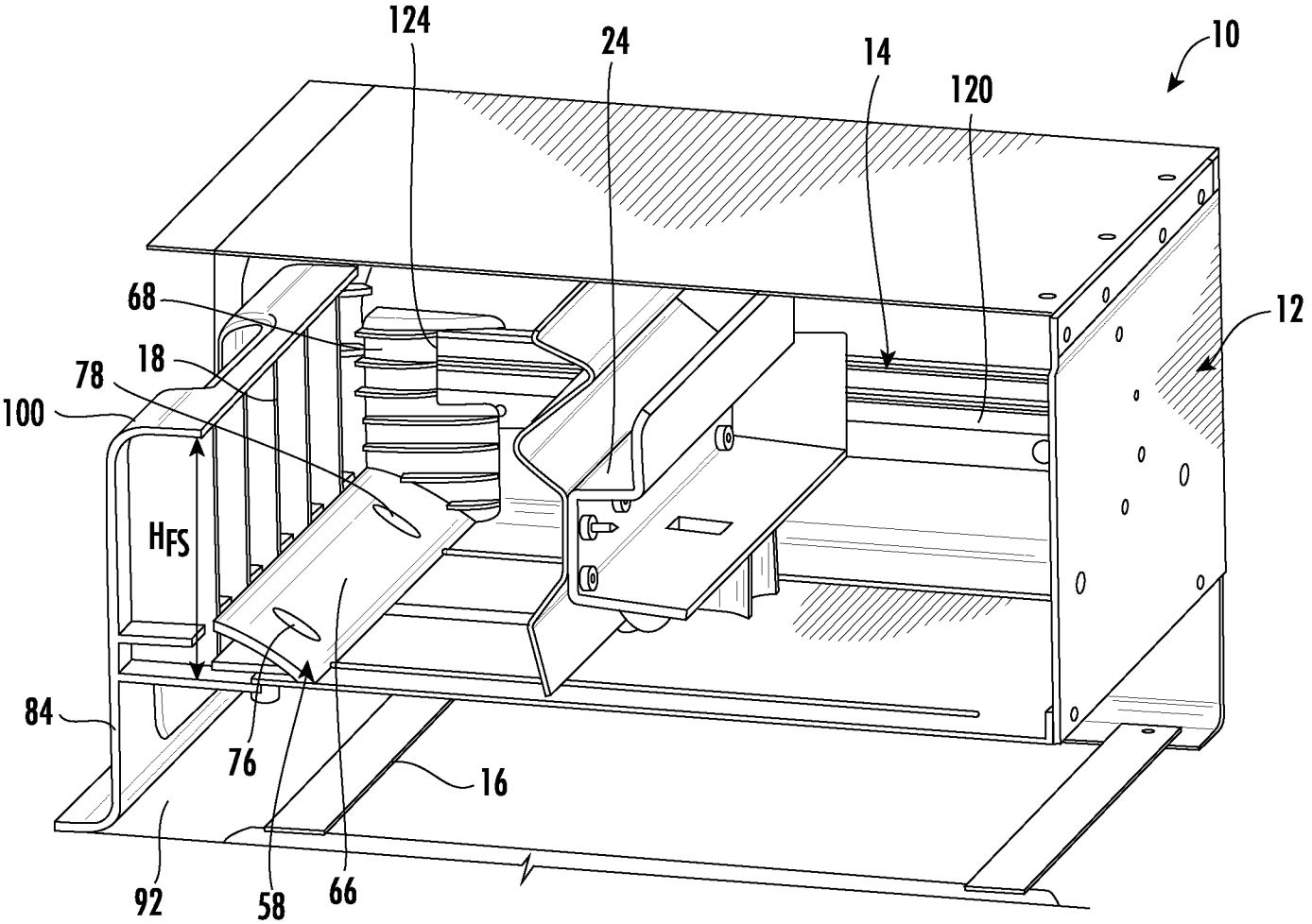
FIG. 7 is a cross-sectional view of an example sheet product dispenser such as shown in FIG. 1 taken along line B-B (with a note that the bottom of the sheet product dispenser in FIG. 7 is different than the sheet product dispenser in FIG. 1), in accordance with some embodiments discussed herein.
Figure 8A:
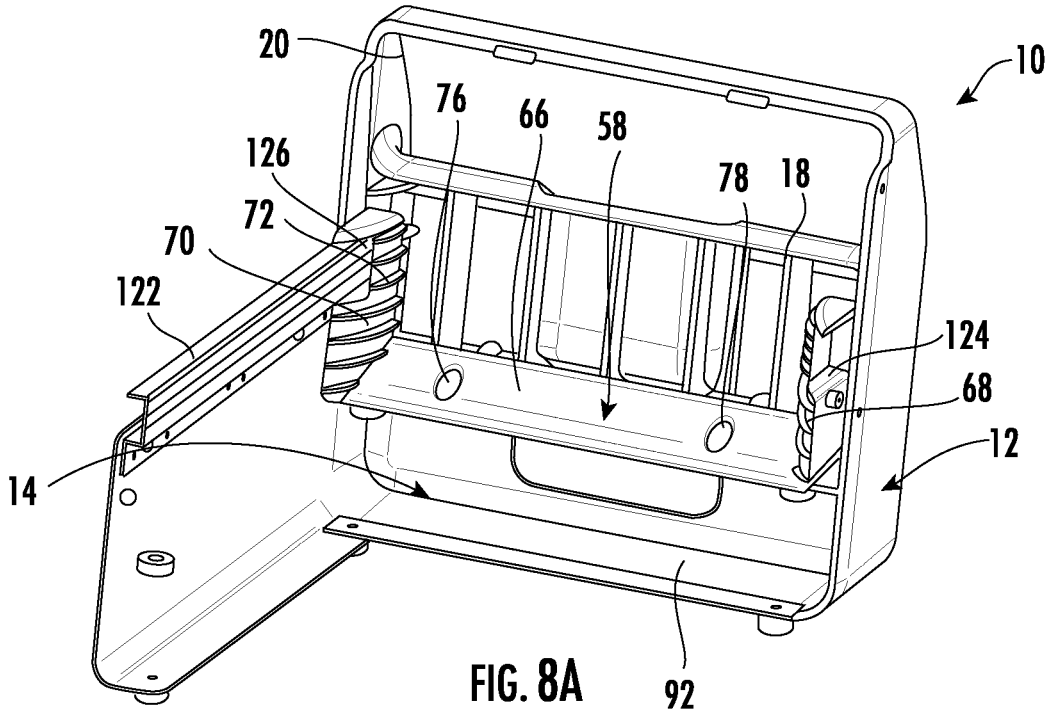
FIG. 8A shows a perspective view of a portion of an example sheet product dispenser, in accordance with some embodiments discussed herein.
Figure 8B:
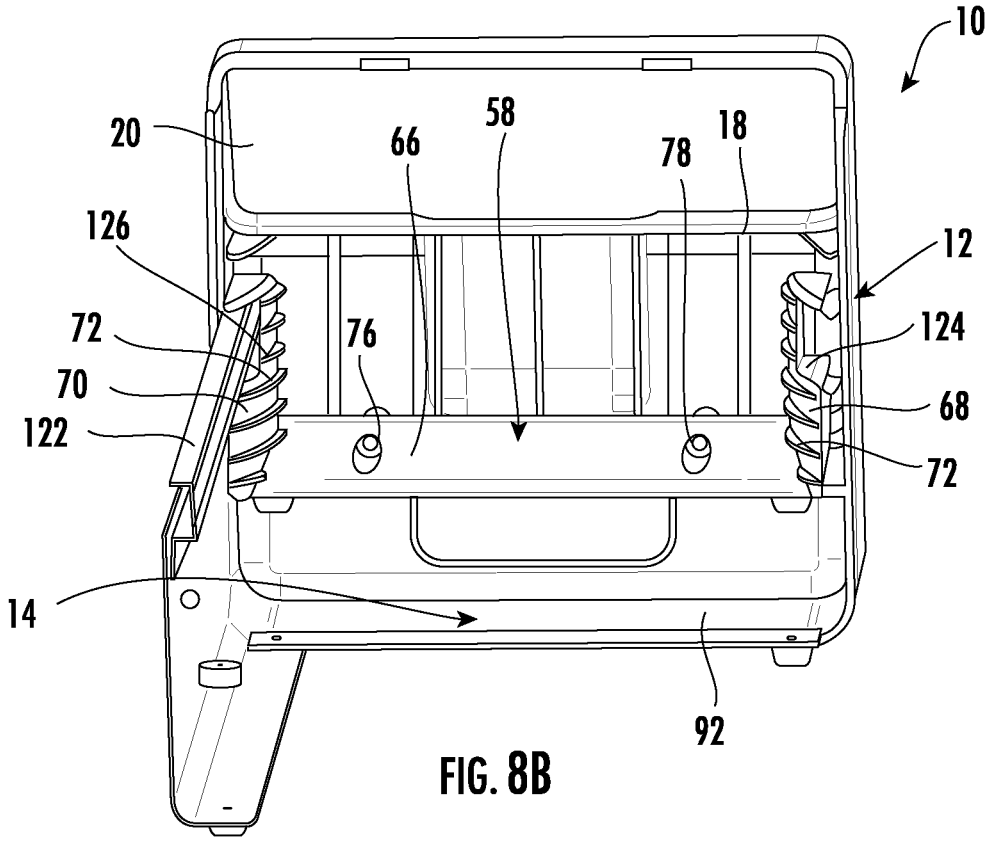
FIG. 8B shows a back view of the portion of an example sheet product dispenser shown in FIG. 8A, in accordance with some embodiments discussed herein.

Accordingly, in some embodiments, a curvature of a surface 66 of the ramp 58 may be configured such that the ramp 58 does not lessen as much force from the third folded sheet product 48 as it does from the first folded sheet product 28 and the second folded sheet product 44. That is, in some embodiments, the ramp may lessen the force from the first folded sheet product 28 and the second folded sheet product 44, but it may maintain a higher force on the third folded sheet product 48. In this way, the force may be lessened on the first and second folded sheet products 28, 44 so that they can be presented through the opening 20, but the force may remain great enough on the third folded sheet product 48 so that it is not presented through the opening 20 when the first and second folded sheet products 28, 44 are presented through the opening 20. For example, in some embodiments, the curvature of the ramp may vary such that the angle 62 decreases as the ramp 58 extends toward the front surface 18. In this regard, in some embodiments, the ramp 58 may have a constant radius of curvature over the entire surface 66 of the ramp 58, as is shown in FIG. 7. In some other embodiments, however, the ramp 58 may have a first portion that has a smaller radius of curvature and a second portion with a larger radius of curvature (not shown). Further, in some embodiments, the surface 66 of the ramp 58 may be straight (e.g., having a radius of curvature that is infinite). In other embodiments, the surface 66 of the ramp 58 may be any other shape (e.g., disjointed, not smooth, have ledges, etc.) or any material (e.g., plastic, rubber, among others) that allows the force from the biasing element 24 to be lessened from the first and second folded sheet products 28, 44, as described above.

The ramp 58 may be further configured to lessen the force applied by the biasing element 24 from the third folded sheet product 48 and the fourth folded sheet product 50 after the first folded sheet product 28 and the second folded sheet product 44 are dispensed. In the same way in which the ramp may lessen the force applied on the first folded sheet product 28 and the second folded sheet product 44 before the first folded sheet product 28 and the second folded sheet product 44 are dispensed, the ramp may lessen the force on the third and fourth folded sheet products 48, 50 so that they can be presented through the opening 20, but it may maintain a force on a fifth folded sheet product 52 that is great enough so that the fifth folded sheet product 52 is not presented through the opening 20 when the third and fourth folded sheet products 48, 50 are presented through the opening 20. The presentation of the third folded sheet product 48 and the fourth folded sheet product 50 may enable the user to grab the crease 54 of the third folded sheet product 48 along with the first end 56 of the fourth folded sheet product 50 such that a single manual removal of the crease 54 of the third folded sheet product 48 may dispense both the third folded sheet product 48 and the fourth folded sheet product 50 to the user.

Referring now to FIGS. 7-10, the sheet product dispenser 10 may have one or more side ramps 68, 70 configured to apply a frictional force on the plurality of folded sheet products 26. In the embodiments shown in FIGS. 7-10, the sheet product dispenser includes side ramps 68, 70. In some embodiments, the sheet product dispenser 10 may only have one side ramp, and in other embodiments, the sheet product dispenser may have more side ramps, or it may have any other mechanism that helps prevent more than two sheet products from being presented to a user through the opening 20 at once, such as described herein. In some embodiments, the side ramps 68, 70 may be disposed within the housing 12 of the sheet product dispenser 10 such that the side ramps 68, 70 are adjacent to the ramp 58 and to an interior portion of the front surface 18. Further, in some embodiments, each of the side ramps 68, 70 may have a height that is between 1.25 inches and 2.5 inches, or in other embodiments, the height of each of the side ramps 68, 70 may be any other height which causes a frictional force to be applied to the plurality of folded sheet products 26 but that also allows for at least a top portion of a folded sheet product of the plurality of folded sheet products 26 to fall forward toward the opening 20.

In some embodiments, the side ramps 68, 70 may each comprise one or more retention edges, such as the disclosed ribs 72. As illustrated, one or more ribs 72 may be oriented horizontally such that the plurality of folded sheet products 26 can glide along a horizontal direction H, but such that the one or more ribs 72 exert a frictional force on the plurality of folded sheet products 26 in a vertical direction V (illustrated in FIG. 5). The frictional force provided by the retention edge(s) may be enough to aid in preventing subsequent folded sheet products of the plurality of folded sheet products 26 (such as the third folded sheet product 48 and the fourth folded sheet product 50 when the first folded sheet product 28 and the second folded sheet product 44 are being dispensed) from contacting a ceiling 128 of the sheet product dispenser 10 (which may otherwise interfere with the crease of the third folded sheet product 48 and the first end of the fourth folded sheet product 50 from falling through the opening 20). In other embodiments, the retention edge or retention edges may be oriented in any other direction which allows the side ramps 68, 70 to apply a frictional force on the plurality of folded sheet products 26 in a direction such that only two folded sheet products are dispensed per single manual removal by a user.

Figure 9A:
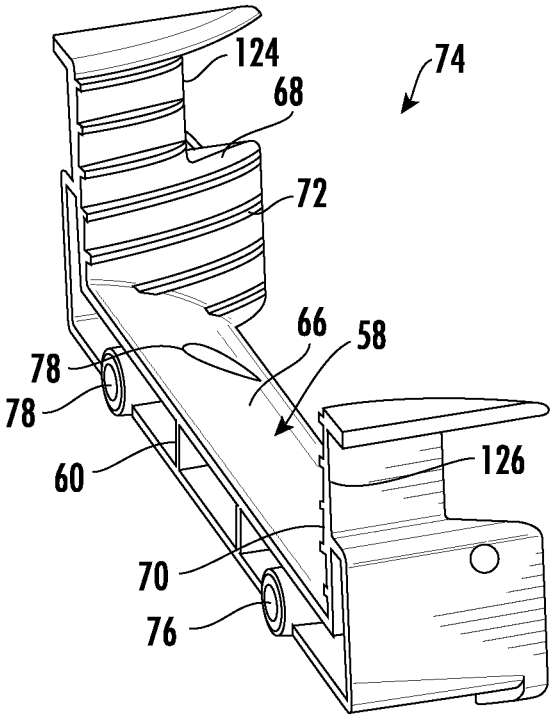
FIG. 9A shows a perspective side view of an example assembly of a ramp and two side ramps that may be fitted into an example sheet product dispenser, in accordance with some embodiments discussed herein.
Figure 9B:
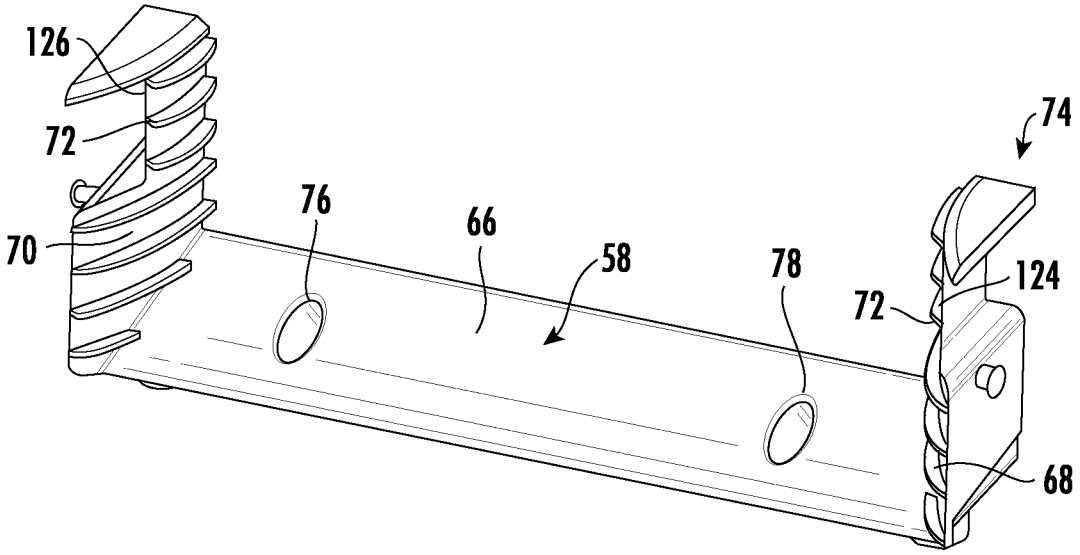
FIG. 9B shows a perspective front view of the example assembly of a ramp and two side ramps shown in FIG. 9A, in accordance with some embodiments discussed herein.
Figure 10:
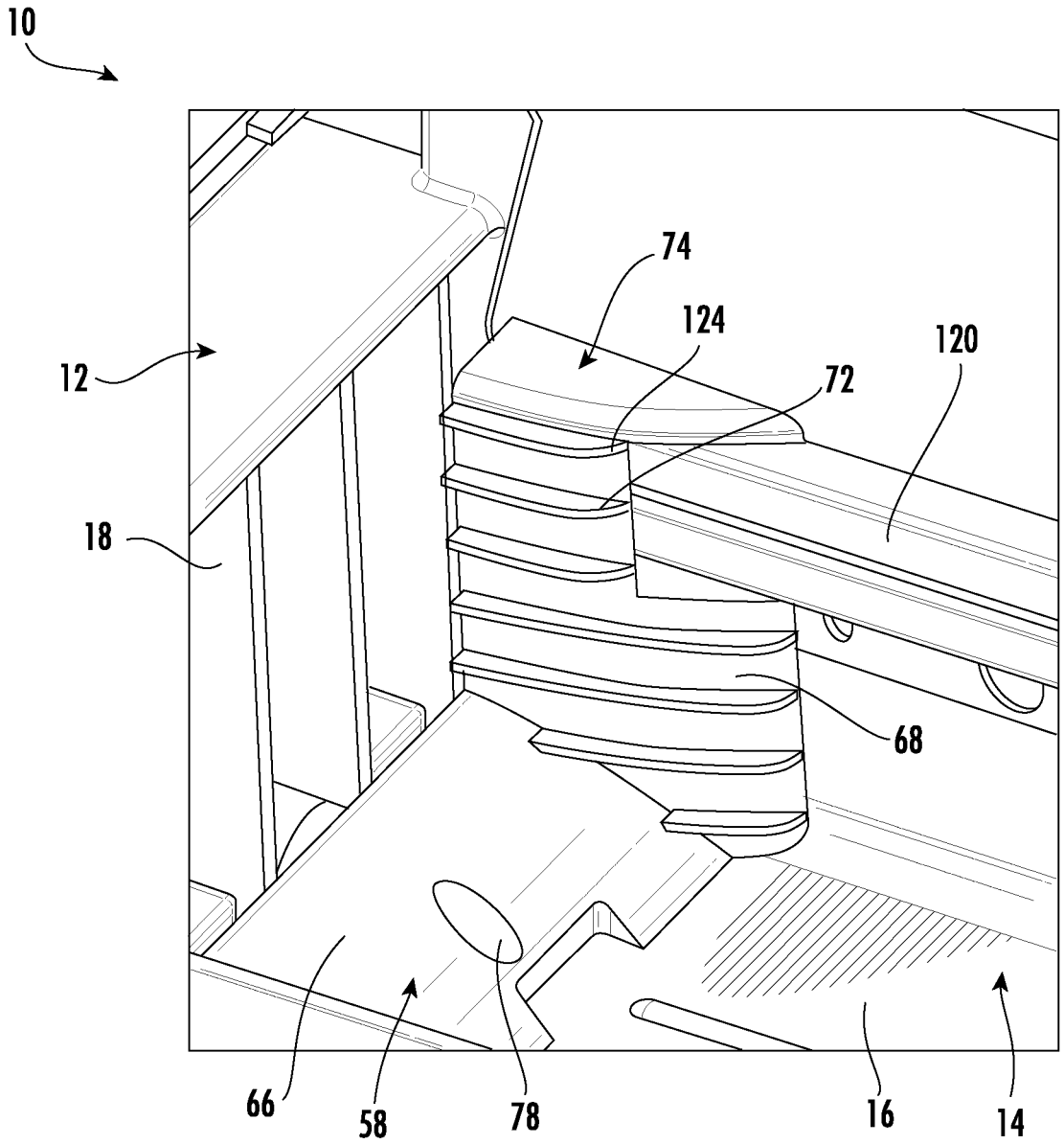
FIG. 10 shows a up-close perspective view of an example assembly of a ramp and two side ramps that is positioned in an example sheet product dispenser, in accordance with some embodiments discussed herein.

In some embodiments, the side ramps 68, 70 may be integrated with the ramp 58 into a single assembly 74, such as shown in FIGS. 9A-9B. In some further embodiments, the assembly 74 may be configured such that it can be retrofitted into the housing 12 of the sheet product dispenser 10 by placing screws through the holes 76, 78. Further, slots 124, 126 of the side ramps 68, 70 may be configured to clearance fit around railings 120, 122 of the sheet product dispenser 10. In other embodiments, the assembly 74 may be installed within the housing 12 in any other way, and the ramp 58 and the side ramps 68, 70 may not be integrated into a single assembly.

In some embodiments, the ramp 58 may be disposed on the side surface of the housing 12 proximate the front surface 18, and side ramps 68, 70 may not be needed. In such embodiments, the ramp 58 may itself comprise one or more retention edges, such as described above with respect to side ramps 68, 70. Alternatively, the ramp 58 may not include any retention edges. Further, in some other embodiments, the ramp 58 may be disposed on the side surface of the housing 12 proximate the front surface 18, and the sheet product dispenser 10 may also comprise the one or more side ramps 68, 70 configured to apply a frictional force on the plurality of folded sheet products 26.

Figure 11:
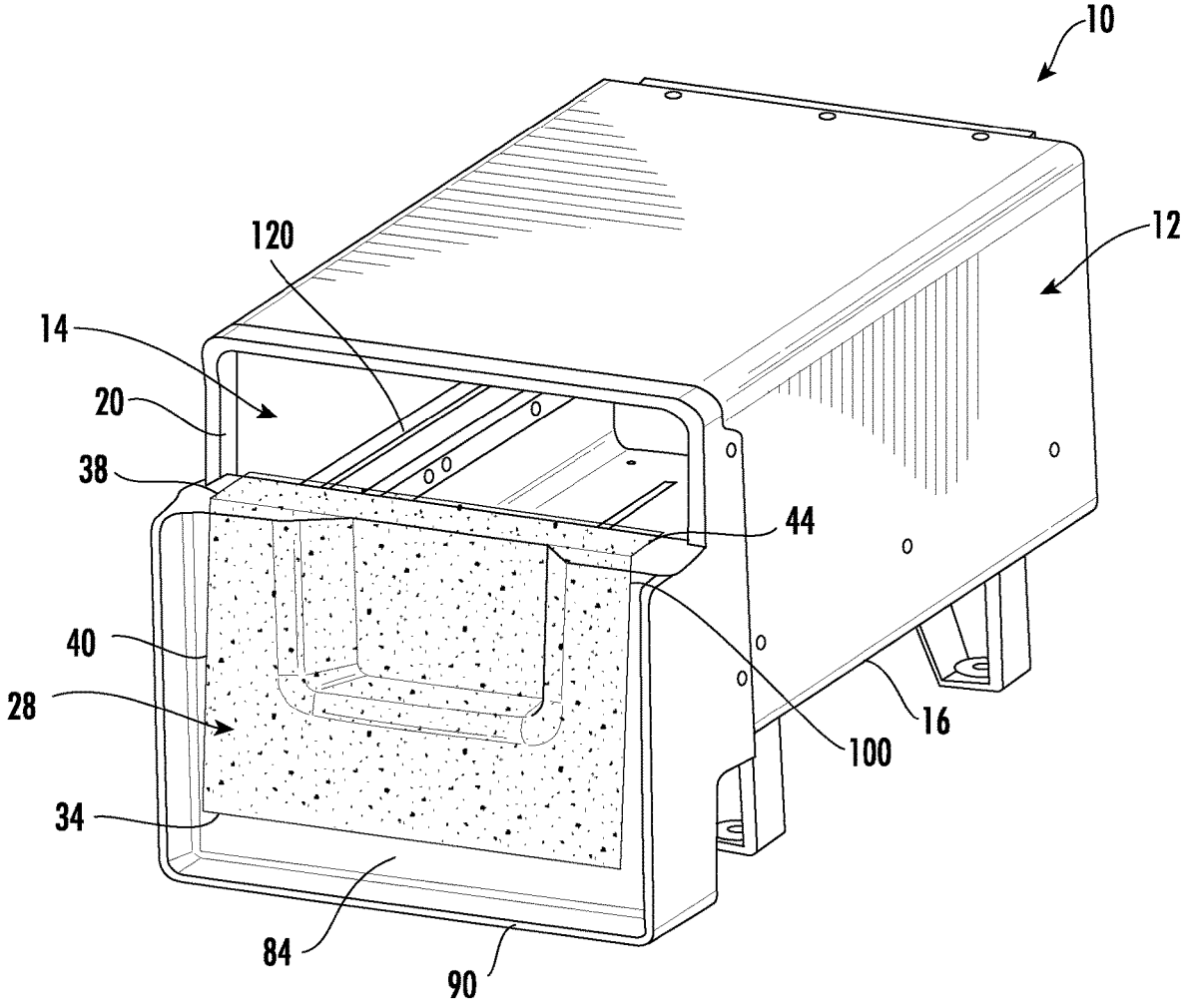
FIG. 11 shows a perspective view of an example sheet product dispenser, illustrating a first folded sheet product presented to a user for pulling the crease thereof, in accordance with some embodiments discussed herein.

Referring now to FIG. 11, the sheet product dispenser 10 may have a faceplate 84 disposed on an exterior portion of the front surface 18. In some embodiments, such as is depicted in FIG. 11, the faceplate 84 may extend below the bottom surface 16. In this way, the faceplate 84 may define a length Les that is greater than a length $L_{FP}$ of the first portion 40 of the first folded sheet product 28 such that the first end 34 of the first folded sheet product 28 is above a bottom edge 90 of the faceplate 84 when the crease 38 of the first folded sheet product is presented to the user. This may ensure that the first folded sheet product 28 does not extend past the length Les of the faceplate 84 and touch any other surface or object for purposes, such as for hygiene purposes.

In some embodiments, the sheet product dispenser may have risers 91 which extend between the bottom surface 16 and a plane in which the bottom edge 90 of the faceplate 84 lays, as shown in FIG. 6. In other embodiments, such as is depicted in FIG. 7, the sheet product dispenser 10 may be configured without risers 91, and instead, the bottom surface 16 may be disposed within the sheet dispenser 10 such that the faceplate 84 extends below the bottom surface 16 and is connected to a bottom connector 92. In some further embodiments, the sheet product dispenser 10 may be configured in any other way which allows for the sheet products to be dispensed through the opening 20.

Referring back to FIG. 11 (and with reference to FIG. 6), the faceplate 84 may comprise an indentation 22 disposed beneath the opening 20. In some embodiments, the indentation 22 is configured such that both the first folded sheet product 28 and the second folded sheet product 44 are dispensed when the user grabs the crease 38 of the first folded sheet product 28 within the indentation 22 and pulls the first folded sheet product 28 and the second folded sheet product 44 out from the housing 12 (the indentation 22 is shown through a partially transparent first portion 40 of the first folded sheet product 28 in FIG. 11). The indentation 22 may be sized such that at least portions of the crease 38 of the first folded sheet product 28 and the first portion 40 of the first folded sheet product 28 overlay the indentation 22 when the first folded sheet product 28 and the second folded sheet product 44 are presented to the user. The indentation 22 may further be configured to encourage a user to grab the crease 38 of the first folded sheet product 28 rather that the first end 34 of the first folded sheet product 28. That is, with the first end of the first folded sheet product 28 overlaying a portion of the faceplate 84 that does not contain the indentation 22, the user may have more difficulty grabbing the first end of the first folded sheet product 28 than he/she may have grabbing the crease 38 of the first folded sheet product 28. In this way, a length $L_I$ of the indentation 22 (shown in FIG. 6) may be less than the length Lip of the first portion 40 of the first folded sheet product 28, such that the first portion 40 covers the indentation 22 when the crease 38 of the first folded sheet product 28 is presented to the user. In other embodiments, however, the length $L_I$ of the indentation 22 and the length $L_{FP}$ of the first portion 40 of the first folded sheet product 28 may be different (e.g., the first portion 40 may not cover the indentation 22 when the crease 38 of the first folded sheet product 28 is presented to the user). Or, in some other embodiments, the faceplate 84 may not have an indentation at all.

In some embodiments, the faceplate may define a perimeter 98 (shown in FIG. 6) that surrounds the hanging first portion 40 of the first folded sheet product 28. The perimeter 98 may provide increased hygiene safety and/or discourage a user from grabbing at the perimeter of the first portion 40—and thereby encouraging a user to grab at the crease 38 as described herein.

As shown in FIGS. 1-2 and 11, an external portion of the front surface 18 may define an external edge 100 at a top of the faceplate 84. The crease 38 of the first folded sheet product 28 may rest along the external edge 100 when the first folded sheet product 28 and the second folded sheet product 44 are ready to be dispensed together. The external edge 100 may help encourage the user to grab the crease 38 of the first folded sheet product 28 rather than grabbing the first end 34 of the first folded sheet product 28. That is, it may be easier and/or more intuitive for the user to grab the first folded sheet product 28 along the crease 38, which rests along the external edge 100, than it may be for the user to grab the first end 34 of the first folded sheet product 28, which may rest against a portion of the faceplate 84 below the external edge 100 (and which may be surrounded by a perimeter 98, as noted above).

Referring to FIGS. 7 and 11, in some embodiments, a height $H_{FS}$ of the front surface 18 measured from the bottom surface 16 to the external edge 100 (as shown in FIG. 7) and the length $L_{FP}$ of the first portion 40 of the first folded sheet product 28 (as shown in FIG. 3B) may define a ratio that is 2:3 or less. The 2:3 or less ratio may allow for the first folded sheet product 28 to fall through the opening 20 so that the crease 38 is presented to the user, e.g., within indentation 22 and/or along the external edge 100. Along these lines, the height $H_{FS}$ of the front surface 18 relative to the length $L_{FP}$ of the first portion 40 of the first folded sheet product 28 may be important for providing enough space to encourage (such as under gravity due to the weight of a front part of the first portion 40 hanging down) the first portion 40 to hang forward to present the crease 38 (and the first end 46 of the second folded sheet product 44) to the user (e.g., as shown in FIG. 6). Notably, in some embodiments, the ratio may fall between 2:3 and, for example, 1:2. In this regard, if the height $H_{FS}$ of the front surface 18 is too low relative to the length $L_{FP}$ of the first portion 40 of the first folded sheet product 28, the first folded sheet product may not be presented properly (e.g., there may not be enough resistance to the biasing element and/or too much of the first folded sheet product may have fallen out of the opening such that the crease is not properly positioned). In some embodiments, the ratio may be configured such that the crease 38 of the first folded sheet product 28 falls through the opening 20 in any other way. In some embodiments, the height $H_{FS}$ of the front surface 18 and the length $L_{FP}$ of the first portion 40 of the first folded sheet product 28 may define any other ratio. For example, the height $H_{FS}$ of the front surface 18 and the length $L_{FP}$ of the first portion 40 of the first folded sheet product 28 may define a ratio such that more than two folded sheet products fall through the opening for dispensing. In some such embodiments, the corresponding dispenser may therefore be designed to provide more than 2 sheet products per dispense (e.g., a user may grasp two creases, for example, to dispense 4 sheet products).

In some embodiments, the sheet product dispenser 10 may be operational even if the plurality of folded sheet products 26 is installed in a different way (e.g., upside down). For example, if the plurality of folded sheet products 26 is installed in the sheet product dispenser 10 such that the crease 38 of the first folded sheet product 28 is on the bottom surface 16 and/or ramp 58 (e.g., if the plurality of sheet products 26 is installed upside down with respect to the illustration of FIGS. 5-6), the user may grab the first end 34 of the first folded sheet product 28 through the opening and cause the sheet product dispenser 10 to dispense the first folded sheet product 28 by itself. After the first folded sheet product 28 has been dispensed, the second folded sheet product 44 and the third folded sheet product 48 may be dispensed together as described above (e.g., by the user grabbing the crease 64 of the second folded sheet product 44 along with the first end 104 of the third folded sheet product 48).

Similarly, in some embodiments, the sheet product dispenser 10 may be configured such that it is still operational even if the user grabs the first end of the first folded sheet product 28 instead of the crease 38 of the first folded sheet product 28 and causes only the first folded sheet product 28 to be dispensed (instead of causing both the first folded sheet product 28 and the second folded sheet product 44 to be dispensed together). If the user grabs only the first end 34 of the first folded sheet product 28 and causes the first folded sheet product 28 to be dispensed by itself, the user may then grab the first end 46 of the second folded sheet product 44 and cause the sheet product dispenser 10 to dispense the second folded sheet product 44 by itself. After the second folded sheet product 44 has been dispensed, the third folded sheet product 48 and the fourth folded sheet product 50 may be dispensed together as described above (e.g., by the user grabbing the crease 54 of the third folded sheet product 48 along with the first end 56 of the fourth folded sheet product 50).

Figure 12:
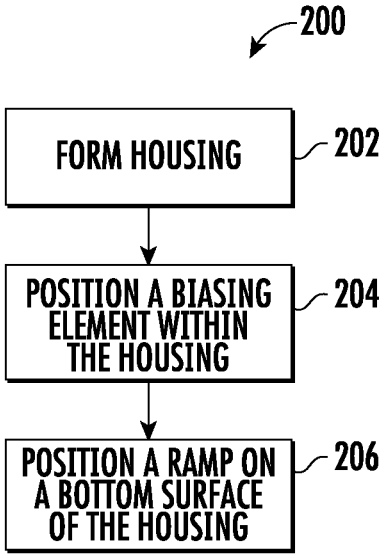
FIG. 12 illustrates a flowchart of an example method of manufacturing a sheet product dispenser, in accordance with some embodiments discussed herein.

FIG. 12 illustrates a flowchart according to an example method 200 for manufacturing a sheet product dispenser according to various example embodiments described herein. The method 200 may include, at operation 202, forming a housing. For example, the housing may be similar to the housing 12 described with reference to the sheet product dispenser 10 above. In some embodiments, the housing could be formed using, for example, injection molded plastic. In other embodiments, the housing may be manufactured using any other process and/or material. Further, the method 200 may include, at operation 204, positioning a biasing element within the housing. For example, the biasing element may be similar to the biasing element 24 described herein. Additionally, the method 200 may include, at operation 206, positioning a ramp within the housing. For example, the ramp may be similar to the ramp 58 described herein, which may be disposed on the bottom surface 16 of the housing 12 of the sheet product dispenser 10. Additional or different operations may be performed in accordance with various embodiments described herein. For example, a plurality of folded sheet product may be installed once the sheet product dispenser is formed, and dispensing may occur thereafter.

Conclusion

Many modifications and other embodiments of the disclosure set forth herein may come to mind to one skilled in the art to which these embodiments pertain having the benefit of the teachings presented in the foregoing descriptions and the associated drawings. Therefore, it is to be understood that the embodiments are not to be limited to what is specifically disclosed and that modifications and other embodiments are intended to be included within the scope of the disclosure. Moreover, although the foregoing descriptions and the associated drawings describe example embodiments in the context of certain example combinations of elements and/or functions, it should be appreciated that different combinations of elements and/or functions may be provided by alternative embodiments without departing from the intended scope. In this regard, for example, different combinations of elements and/or functions than those explicitly described above are also contemplated within the intended scope. Although specific terms are employed herein, they are used in a generic and descriptive sense only and not for purposes of limitation.

That which is claimed:

1. A sheet product dispenser comprising:

a housing defining an interior volume and including a bottom surface and a front surface, the front surface defining, at least in part, an opening;

a plurality of folded sheet products positioned within the interior volume, wherein each of the plurality of folded sheet products has a length from a first end to a second end and a width, wherein each of the plurality of folded sheet products includes a crease extending along the width at a position between the first end and the second end, wherein the plurality of folded sheet products includes at least a first folded sheet product and a second folded sheet product positioned subsequent to the first folded sheet product, wherein the plurality of folded sheet products are interleaved such that a first end of the second folded sheet product is positioned within the crease of the first folded sheet product;

a biasing element disposed within the housing, the biasing element configured to bias the plurality of folded sheet products toward the opening; and a ramp disposed on the bottom surface of the housing proximate the front surface or a side surface of the housing proximate the front surface, wherein the ramp leads upwardly from the bottom surface toward the opening or from the side surface toward a center of the opening, wherein the bias of the biasing element on the plurality of folded sheet products causes the first folded sheet product and the second folded sheet product to move along the ramp toward the opening and causes the crease of the first folded sheet product and the first end of the second folded sheet product to fall through the opening and be presented to a user to enable the user to grab the crease of the first folded sheet product along with the first end of the second folded sheet product such that a single manual removal of the crease of the first folded sheet product dispenses both the first folded sheet product and the second folded sheet product to the user.

2. The sheet product dispenser of claim 1, wherein the first folded sheet product defines a first portion extending between the first end and the crease, and wherein an exterior portion of the front surface defines an indentation such that at least portions of the crease of the first folded sheet product and the first portion of the first folded sheet product overlay the indentation.

3. The sheet product dispenser of claim 2, wherein both the first folded sheet product and the second folded sheet product are dispensed when the user grabs the crease of the first folded sheet product within the indentation and pulls the first folded sheet product and the second folded sheet product out from the housing.

4. The sheet product dispenser of claim 2, wherein the first portion defines a first length, wherein the indentation has a second length in a vertical direction that is less than the first length of the first portion of the first folded sheet product such that the first portion covers the indentation when the crease of the first folded sheet product is presented to the user.

5. The sheet product dispenser of claim 1, wherein the first folded sheet product defines a first portion extending between the first end and the crease, wherein the first portion defines a first length, wherein an exterior portion of the front surface extends downwardly from the opening and defines a second length that is greater than the first length such that the first end of the first folded sheet product is above a bottom edge of the exterior portion of the front surface when the crease of the first folded sheet product is presented to the user.

6. The sheet product dispenser of claim 1, wherein the ramp is disposed on the bottom surface of the housing proximate the front surface, wherein the sheet product dispenser further includes a side ramp disposed within the housing, wherein the side ramp is adjacent to the ramp and an interior portion of the front surface, and wherein the side ramp has a retention edge.

7. The sheet product dispenser of claim 6, wherein a height of the side ramp is between 1.25 inches and 2.5 inches.

8. The sheet product dispenser of claim 6, wherein the retention edge is a plurality of ribs oriented horizontally such that the plurality of folded sheet products can glide along a horizontal direction but such that the plurality of ribs exert a frictional force on the plurality of folded sheet products in a vertical direction.

9. The sheet product dispenser of claim 1, wherein the sheet product dispenser further comprises a third folded sheet product of the plurality of folded sheet products that is adjacent to the second folded sheet product, and wherein a curvature of the ramp varies to cause lessening of force on the first folded sheet product and the second folded sheet product but retaining of force on the third folded sheet product such that the single manual removal of the crease of the first folded sheet product dispenses both the first folded sheet product and the second folded sheet product, but not the third sheet product, to the user.

10. The sheet product dispenser of claim 9, wherein the sheet product dispenser further comprises a fourth folded sheet product of the plurality of folded sheet products that is adjacent to the third folded sheet product, and wherein the single manual removal of the crease of the first folded sheet product causes a second end of the third folded sheet product and a crease of the fourth folded sheet product to move along the ramp under the bias of the biasing element to cause a crease of the third folded sheet product to fall through the opening such that the crease of the third folded sheet product and a first end of the fourth folded sheet product fall at least partially through the opening and are presented to the user.

11. The sheet product dispenser of claim 1, wherein an external portion of the front surface defines an external edge at a top of the front surface, and wherein the front surface defines a height such that the crease of the first folded sheet product rests along the external edge when the first folded sheet product and the second folded sheet product are ready to be dispensed together.

12. The sheet product dispenser of claim 11, wherein the first folded sheet product defines a first portion extending between the first end and the crease, wherein the first portion defines a first length, and wherein the height of the front surface and the first length of the first folded sheet product define a ratio that is 2:3 or less.

13. The sheet product dispenser of claim 1, wherein a height of the ramp is between 0.5 inches and 1.5 inches.

14. The sheet product dispenser of claim 1, wherein an angle of the ramp relative to the bottom surface is between 20 degrees and 60 degrees.

15. The sheet product dispenser of claim 1, wherein the ramp has a first portion that has a first radius of curvature, the first portion being adjacent to the bottom surface, wherein the ramp has a second portion that has a second radius of curvature, the second portion being adjacent to an interior portion of the front surface, and wherein the first radius of curvature is less than the second radius of curvature.

16. The sheet product dispenser of claim 1, wherein the biasing element exerts a force onto the plurality of folded sheet products, and wherein a curvature of the ramp causes less of the force to be applied to the first folded sheet product and the second folded sheet product when the ramp forces the first folded sheet product and the second folded sheet product along the ramp to cause the crease of the first folded sheet product and the first end of the second folded sheet product to be presented to the user such that it is easier to remove the first folded sheet product and the second folded sheet product relative to the third folded sheet product and other folded sheet products of the plurality of folded sheet products and so as to encourage removal of only the first folded sheet product and the second folded sheet product with the single manual removal.

17. The sheet product dispenser of claim 1, wherein the first folded sheet product defines a first portion extending between the first end and the crease, and wherein a weight of the first portion of the first folded sheet product enables the crease of the first folded sheet product to fall through the opening and hang at a position relative to the front surface that encourages removal of two sheet products with the single manual removal.

18. The sheet product dispenser of claim 1, wherein the sheet product dispenser is a napkin dispenser.

19. A system for dispensing sheet products, the system comprising:

a housing defining an interior volume, the housing configured to accept a plurality of folded sheet products, wherein each of the plurality of folded sheet products has a length from a first end to a second end and a width, wherein each of the plurality of folded sheet products includes a crease extending along the width at a position between the first end and the second end, wherein the plurality of folded sheet products includes at least a first folded sheet product and a second folded sheet product positioned subsequent to the first folded sheet product, wherein the plurality of folded sheet products are interleaved such that a first end of the second folded sheet product is positioned within the crease of the first folded sheet product, and wherein the housing further comprises:

a bottom surface; and a front surface that, alone or together with a top portion of the housing, creates an opening for a crease of the first folded sheet product to fall through;

a biasing element disposed within the housing, the biasing element configured to bias the plurality of folded sheet products toward the opening; and a ramp disposed on the bottom surface of the housing proximate the front surface or a side surface of the housing proximate the front surface, wherein the ramp leads upwardly from the bottom surface toward the opening or from the side surface toward a center of the opening, wherein the bias of the biasing element on the plurality of folded sheet products causes the first folded sheet product and the second folded sheet product to move along the ramp toward the opening and causes the crease of the first folded sheet product and the first end of the second folded sheet product to fall through the opening and be presented to a user to enable the user to grab the crease of the first folded sheet product along with the first end of the second folded sheet product such that a single manual removal of the crease of the first folded sheet product dispenses both the first folded sheet product and the second folded sheet product to the user.

* * * * *